United States Patent [19]

Batchelder

[11] Patent Number: 5,054,107

[45] Date of Patent: Oct. 1, 1991

[54] RADIATING LAMP FLUID HEATING SYSTEM

[76] Inventor: Geoffrey Batchelder, 249 Acalanes Dr., #11, Sunnyvale, Calif. 94086

[21] Appl. No.: 354,157

[22] Filed: May 19, 1989

[51] Int. Cl.[5] ..... F24H 1/00

[52] U.S. Cl. ..... 392/483

[58] Field of Search ..... 219/281, 303, 339, 343, 219/342, 347, 296, 304, 305, 338, 354, 275, 301, 305, 316, 299, 298, 302; 392/483

[56] References Cited

U.S. PATENT DOCUMENTS

| | | | |
|---|---|---|---|
| 1,533,541 | 4/1925 | Derby | 219/338 |
| 1,807,951 | 6/1931 | Ahern | 219/299 |
| 1,906,145 | 4/1933 | Evans | 219/338 |
| 1,926,958 | 9/1933 | Peterson | 219/275 |
| 2,954,826 | 10/1960 | Sievers | 392/483 |
| 3,147,366 | 9/1964 | Dreyfoos | 219/338 |
| 3,167,066 | 1/1965 | Hughes | 219/349 |
| 3,188,459 | 6/1965 | Bridwell | 219/347 |
| 3,519,255 | 7/1970 | Cooper | 219/338 |
| 3,906,188 | 9/1975 | Gamell | 219/338 |
| 4,461,347 | 7/1984 | Layton et al. | 165/133 |
| 4,492,951 | 1/1985 | Apothaker et al. | 219/301 |
| 4,638,147 | 1/1987 | Dytch et al. | 219/298 |
| 4,797,535 | 1/1989 | Martin | 219/338 |

FOREIGN PATENT DOCUMENTS

| | | | |
|---|---|---|---|
| 2731487 | 1/1979 | Fed. Rep. of Germany | 219/305 |
| 3243826 | 5/1984 | Fed. Rep. of Germany | 219/338 |
| 116246 | 6/1986 | Japan | 219/316 |
| 134546 | 10/1929 | Switzerland | 219/303 |

OTHER PUBLICATIONS

Fluidix Inc. doc., "Self-Containing Point of Use Heaters", undated.

Process Technology Corporation ("Protec") doc., New Quartz Ultrapure Heater System, received by applicant Dec. 1988.

Demco doc., Nov. 7, 1986, received by applicant in 1987.

Semiconductor Process Equipment Corporation ("SPEC") doc., Fluid Heating System Model: FHW 2.0, received by applicant Dec. 1988.

*Primary Examiner*—Geoffrey S. Evans

*Attorney, Agent, or Firm*—Limbach, Limbach & Sutton

[57] ABSTRACT

A fluid heating system, which includes a set of lamps emitting infrared or longer wavelength radiation. The fluid to be heated flows through chemically inert tubing while absorbing radiation from the lamps. The lamps are separated from the tubing, so that there is no significant risk that contaminants will enter the tubing during operation. In one class of preferred embodiments particularly well suited for heating ultrapure water, the inert tubing is a quartz coil. Lamps are mounted inside the coil generally parallel to the coil axis. Reflective material is wrapped around the outer surface of the coil to reflect radiation that has passed through the coil back toward the coil axis. The quartz comprising the coil is selected to transmit the lamp radiation efficiently to the fluid within the coil. In one embodiment, the lamps are mounted between a pair of end plate assemblies. Unheated process fluid flowing through chemically inert tubing which lines a spiral duct within each end plate assembly absorbs heat from the lamp ends, thereby preventing the lamps from overheating, before entering an inlet in the quartz coil.

5 Claims, 11 Drawing Sheets

RADIATING LAMP FLUID HEATING SYSTEM

FIELD OF THE INVENTION

The invention is a fluid heating system employing a set of lamps emitting infrared or longer wavelength radiation, to heat fluid flowing within chemically inert tubing. The inert tubing is spaced from the lamps, to avoid contamination of the fluid during the heating process, so that the invention is particularly useful for heating ultrapure fluid, such as ultrapure water for use in semiconductor circuit manufacture.

BACKGROUND OF THE INVENTION

During conventional semiconductor circuit manufacturing, hot ultrapure water is often employed to rinse the circuits being manufactured. It is impractical to purify the water after it has been heated. Accordingly, the water is first purified, and then heated just prior to use. Hot ultrapure water and other ultrapure fluids are employed for many other conventional, commercially useful purposes.

One type of conventional water heating system (described, for example, in U.S. Pat. No. 1,807,951, issued to Ahern on June 2, 1931) includes an elongated chamber which has an annular cross-section. The chamber surrounds an elongated heating element which extends along the chamber's axis. The heating element heats water within the chamber while the water flows axially along the chamber from an inlet to an outlet.

However, this type of conventional heating system does not confine the water being heated within a chemically inert container. Thus, this type of system may contaminate the water due to contact with the chamber itself, or in the event of failure of the chamber, with the heating element or other system components. For this reason, such conventional systems are unsuitable for heating ultrapure water (or other ultrapure fluid) to the high temperatures typically required for use in semiconductor circuit manufacturing, while maintaining the purity of the fluid being heated.

Systems for heating ultrapure water have been proposed. For example, U.S. Pat. No. 4,461,347, issued to Layton, et al. on July 24, 1984, describes such a system in which ultrapure water flows axially within an annular volume between an outer tube and an inner coaxial tube. The coaxial tubes are composed of (or coated with) an inert, non-reactive material such as polytetrafluoroethylene (known as "TEFLON" material). Heat is conducted from hot liquid within the inner tube (or an electrical heating element within the inner tube) to ultrapure water flowing axially within the annular volume. Use of this type of heat exchange mechanism has a number of disadvantages, including the following.

The heat exchange mechanism relies on heat conduction between the inner tube (which may have an inert coating) and flowing ultrapure water. The ultrapure water is in direct contact with the inner tube (or its coating), so that there is a risk that the tube or its coating will fail, thereby exposing the ultrapure water to contaminants.

Furthermore, inert heat source coatings (such TEFLON) in direct contact with ultrapure water (as in the system of U.S. Pat. No. 4,461,347) are suitable only for use within a limited temperature range. A TEFLON material coating, for example, will melt or burn if raised above a critical temperature (typically in the range from about 250 to about 300 degrees Celsius). Thus, conventional heat exchange systems of the described type are unsuited for use with heat sources which would raise the heat source coating temperature above the critical temperature.

Finally, the conductive heat transfer process employed in conventional heat exchange systems of the described type is much less efficient than the radiative heat transfer technique employed in the present invention. Conventional heat exchange systems are particularly inefficient in relation to preferred embodiments of the invention employing a quartz coil with infrared heating lamps which efficiently radiate wavelengths within the high transmissivity "window" of the quartz coil.

Some conventional water heating systems of the heat exchange type heat a volume of liquid, and the heated liquid in turn conducts heat to ultrapure water flowing within adjacent chemically inert tubing (for example, PVDF plastic tubing). In addition to the above-described disadvantages and limitations of heat exchanging systems in general, these systems have employed chemically inert tubing with an undesirably large heat exchange surface area. Use of tubing with such a large surface area undesirably promotes contamination of the water flowing within the tubing due to bacterial growth and the like.

Until the present invention, it had not been known how to design and operate a fluid heating system employing radiating lamp heating elements in a manner eliminating the above-described disadvantages and limitations of conventional systems.

SUMMARY OF THE INVENTION

The invention is a fluid heating system which includes a set of lamps emitting infrared (or longer wavelength) radiation. The fluid to be heated (the "process fluid") flows through chemically inert tubing while absorbing radiation from the lamps. The lamps are separated from the tubing, so that there is no significant risk that contaminants will enter the tubing during operation. Even if the tubing develops a leak during operation, positive fluid pressure within the tubing will force fluid out from the tubing at the leak site while maintaining the purity of the fluid remaining within the tubing.

For convenience, throughout the specification (including the claims), the terms "radiation" and "lamps" will be used to denote infrared (or longer wavelength) radiation and lamps emitting infrared (or longer wavelength) radiation, respectively. The term "lamp" is used in a broad sense throughout the specification (including the claims), to include lamps which emit radiation having wavelength shorter than infrared and also infrared (or longer wavelength) radiation, as well as lamps which emit substantially only infrared (or longer wavelength) radiation.

The phrase "chemically inert tubing" is used throughout the specification (including the claims), to denote tubing which will undergo no significant chemical reactions with the process fluid flowing therein. Tubing may be identified herein as "chemically inert tubing" even if there exists a substance (other than a process fluid to be contained within the tubing) which reacts chemically with the tubing.

In one class of preferred embodiments particularly well suited for heating ultrapure water, the inert tubing is a helical quartz coil. Elongated lamps are mounted inside the coil generally parallel to the coil axis. Reflective material (such as metal foil) is wrapped around the outer surface of the coil to reflect radiation that has passed through the coil back toward the coil axis. The quartz comprising the coil is selected to transmit the lamp radiation efficiently to the fluid within the coil. Because most quartz will efficiently transmit radiation having wavelength in the range from about 0.5 microns to about 5 microns, most of the radiation emitted by the lamps will preferably be infrared radiation having wavelength within this range.

In one preferred embodiment, a set of parallel, elongated lamps are mounted between a pair of end plate assemblies. The lamp ends are supported by a thermally conductive plate portion of each end plate assembly. Chemically inert tubing (which may be TEFLON tubing) lines a spiral duct within the thermally conductive plate portion. Unheated process fluid flowing through the chemically inert tubing will absorb heat that has been radiated and conducted to the thermally conductive plate portion from the lamps (thereby preventing the lamps and associated components from overheating). After performing this cooling function, the process fluid will enter an inlet in the quartz coil, and will thereafter be heated by radiation propagating from the lamps through the quartz coil. The heated process fluid will finally emerge from the quartz coil through an outlet.

In a variation on this embodiment, the thermally conductive lamp mount, and the lamps, are cooled by a gas such as air or $N_2$, instead of (or in addition to) unheated process fluid. In alternative embodiments, the quartz coil through which the process fluid flows has a shape more complicated than a simple helical shape. For example, the quartz coil may comprise three coaxial portions: a large diameter helical portion adjacent a fluid inlet; a linear portion adjacent a fluid outlet; and a small diameter helical portion between the other two portions.

It is contemplated that the invention may be employed to heat liquids (such as ultrapure, deionized water) or gases (such as ultraclean $N_2$, or the like).

BRIEF DESCRIPTION OF THE DRAWINGS

FIG. 11A is a side elevational view of a preferred embodiment of the quartz coil of the inventive system.

DETAILED DESCRIPTION OF THE PREFERRED EMBODIMENTS

Figure 1:
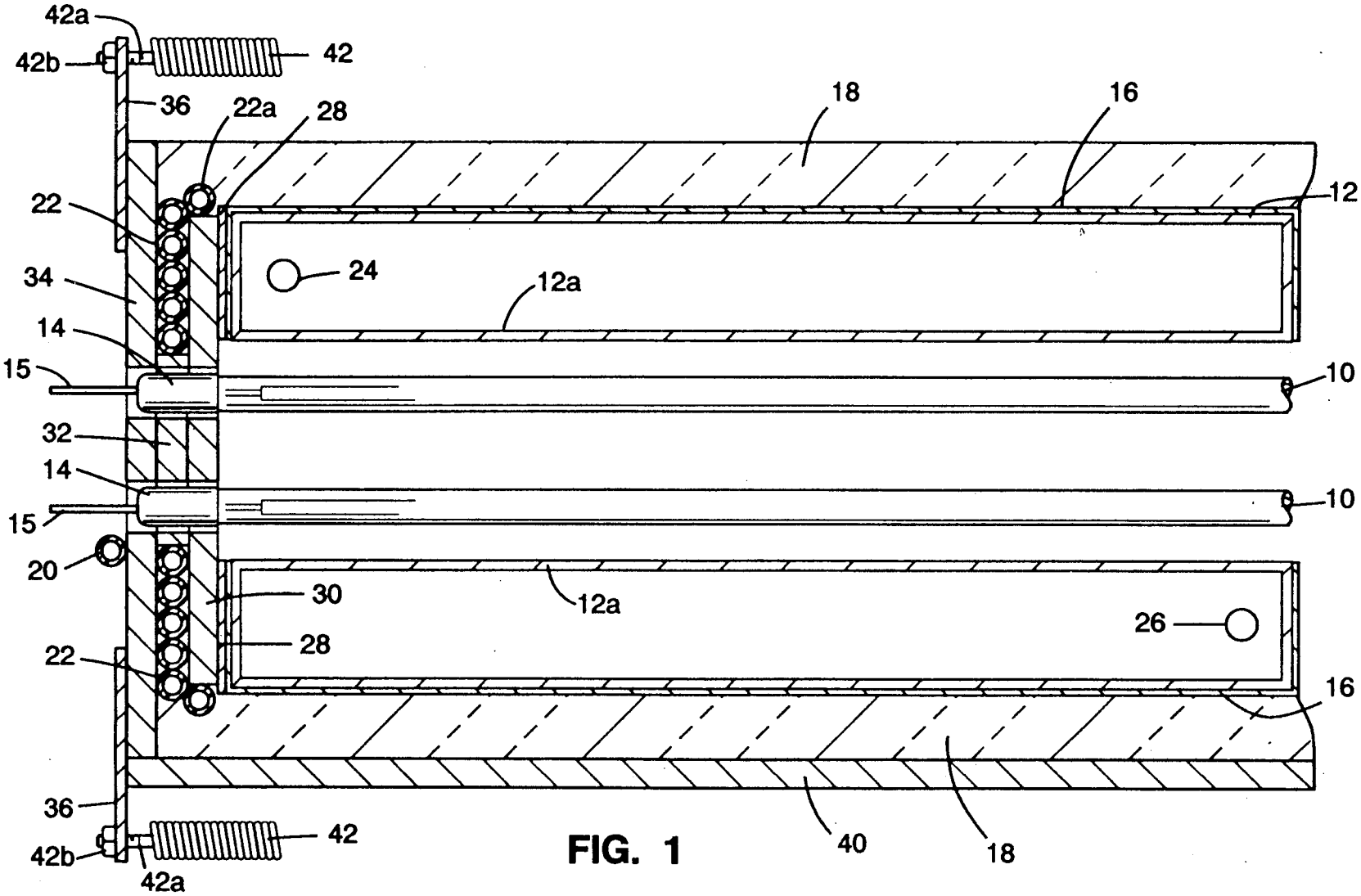
FIG. 1 is a partial side cross-sectional view of a first preferred embodiment of the inventive system.

In FIG. 1, annular quartz tube 12 is mounted around, and separated from, lamps 10. Each lamp 10 has an end 14 supported by a plate assembly comprising inner lamp mounting plate 30, center lamp mounting plate 32, and outer lamp mounting plate 34. Lamp ends 14 are thermally conductive, and mounting plates 30, 32, and 34 are thermally conductive. Preferably, plate 30 is highly reflective, so that it absorbs no more than an insignificant amount of radiation from the lamps.

End assembly support 36 is fixedly attached to plate 34. Together, the components 28, 30, 32, 34, and 36 comprise a left end assembly. An identical (or mirror image) end assembly (not shown in FIG. 1, for simplicity) supports the right end of tube 10 and lamps 10.

Rigid frame member 40 is fixedly attached between the two end plate assemblies (In FIG. 1, support 36 of the left end assembly is shown fixedly attached to member 40). Springs 42 are attached between support 36 of the left end assembly and the corresponding support of the right end assembly, in order to press plate 30 against cushion material 28 (to be described below). In one embodiment, each spring 42 has a threaded end which extends through a hole **42*a* in plate 36. Nut 42*b* is threaded onto the threaded spring end to attach the spring to plate 36**.

Electric signals for powering lamps 10 are supplied on electrical lines 15 to lamp ends 14. In operation, lamps 10 will emit radiation, and the radiation will propagate through inner cylindrical surface **12*a* of annular tube 12 for absorption by process fluid within tube 12**.

Reflector 16 (composed of radiation reflecting material such as metal foil or paint) is wrapped around (or coated over) the outer cylindrical surface, and the left and right end surfaces, of annular tube 12. Thermally insulating material 18 is wrapped around reflector 16. A metal or polymer sheath (not shown) may be positioned around insulating material 18 to hold material 18 in place.

Thermally conductive cushion material 28 fills the space between reflector 16 and plate 30. The primary function of material 28 is to cushion the assembly comprising reflector 16 and tube 12 against impact with plate 30, while accommodating variations in the overall length of tube 12 (due to thermal expansion) without cracking tube 12. The secondary function of material 28 is to conduct excess heat from reflector 16 to plate 30.

Any radiation propagating radially outward from surface 12*a* to reflector 16 (without having been absorbed by fluid within tube 12) will be reflected radially inward from reflector 16 so as to propagate again through the fluid within tube 12. Reflector 16 (including the axial portion around tube 12's outer cylindrical surface and the end portions adjacent material 28) is cooled conductively by tube 12 and the process fluid flowing within tube 12. The end portions of reflector 16 are also cooled by conduction of heat from such end portions, through material 28, and into plate 30.

Unheated process fluid (which may be ultrapure, deionized water) enters coil 22 at inlet 20. Outlet 22*a* of coil 22 is connected to inlet 24 of tube 12 by a fitting not shown in FIG. 1, so that unheated process fluid may flow through coil 22 into tube 12. The process fluid will then flow within tube 12 toward tube 12's right end while it is heated by radiation from lamp 10, and the heated process fluid will emerge from tube 12 through outlet 26. The tubing connected to inlet 24 and outlet 26 are preferably composed of TEFLON material. By controlling the flow rate of fluid within tube 12 or the power supplied to lamps 10 (or both), the system operator can control the amount by which the fluid temperature at outlet 26 will exceed the fluid temperature at inlet 24.

Coil 22 is composed of chemically inert material such as Teflon. Unheated fluid flowing within coil 22 absorbs excess heat which has transferred to plates 30, 32, and 34 (by radiation or conduction) from lamps 10, The unheated process fluid flowing within coil 22 is thus employed to cool lamps 10.

Springs 42 compress material 28 between tube 12 and plate 30, in order to enhance the conductive flow of heat between tube 12 and plate 30, while accommodating any changes in overall axial system length which may result from thermal expansion of the system components.

Figure 2:
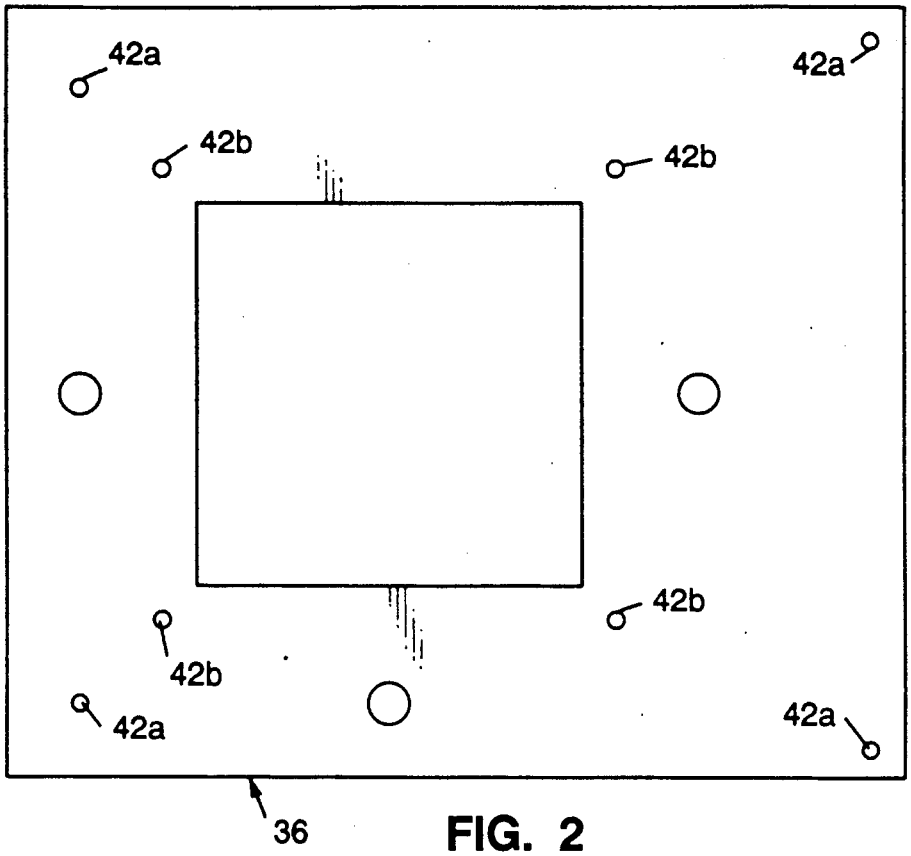
FIG. 2 is an elevational view of an end assembly support of the FIG. 1 system.

FIG. 2 is an end view of end assembly support 36 of FIG. 1. Four holes 42*a* and four holes 42*b* extend through support 36.

Figure 3:
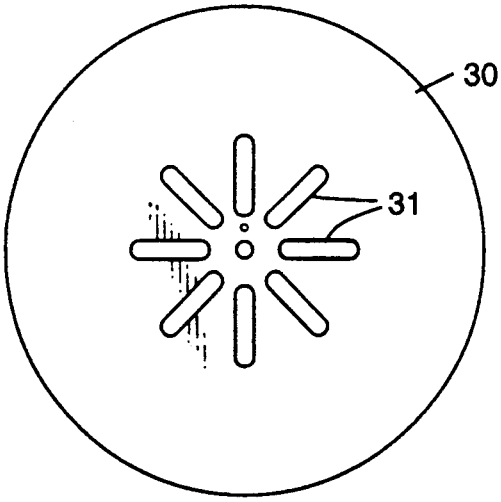
FIG. 3 is an elevational view of an inner lamp mounting plate of the FIG. 1 system.

FIG. 3 is an end view of inner mounting plate 30 of FIG. 1, showing eight slots 31 extending therethrough. Each slot 31 receives one of lamp ends 14. Thus, the FIG. 1 system is capable of mounting up to eight lamps 10. Each embodiment of the invention may include any number of lamps (i.e., a "set" of one or more lamps).

Figure 4:
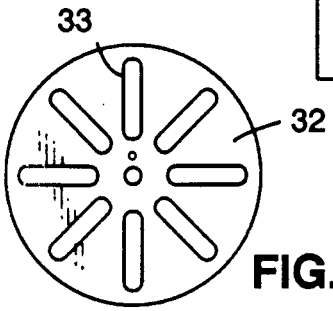
FIG. 4 is an elevational view of a center lamp mounting plate of the FIG. 1 system.

FIG. 4 is an end view of center mounting plate 32 of FIG. 1, showing eight slots 33 extending therethrough. Each slot 33 aligns with one of slots 31 in FIG. 3, for receiving one of lamp ends 14.

Figure 5:
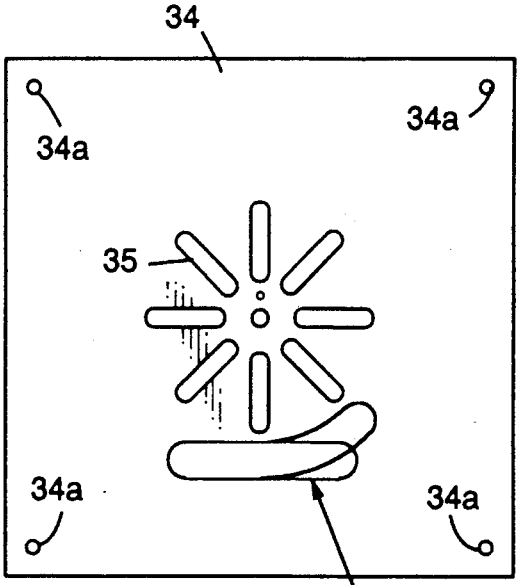
FIG. 5 is an elevational view of an outer lamp mounting plate of the FIG. 1 system.

FIG. 5 is an end view of outer mounting plate 34 of FIG. 1, showing eight slots 35 extending therethrough. Each slot 35 aligns with one of slots 33 in FIG. 4, for receiving one of lamp ends 14. Each hole 34*a* in plate 34 aligns with one of holes 42*b* in support 36 (shown in FIG. 2), so that plate 34 may be attached to support 36 by screws or bolts (not shown) extending through holes 42*b* and 34*a*. Slot 37 in plate 34 is provided for receiving inlet 20, so that inlet 20 may extend through plate 34.

Figure 6:
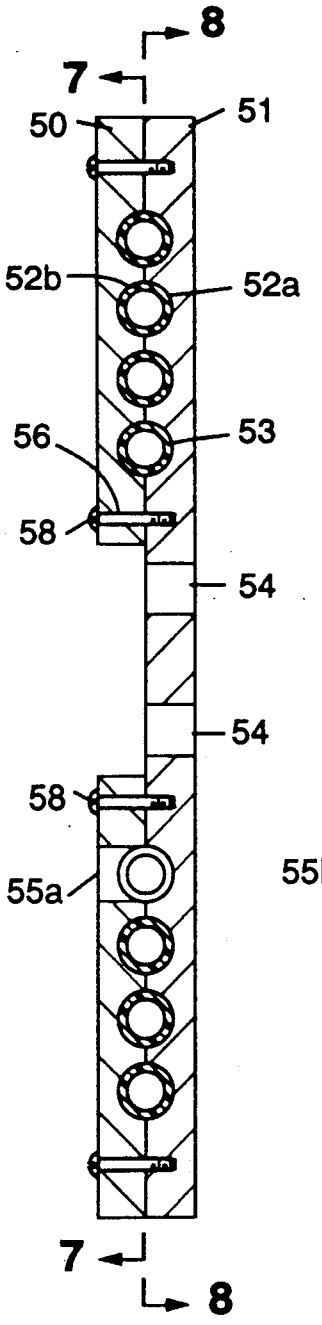
FIG. 6 is a side cross-sectional view of an end portion of a second preferred embodiment of the inventive system.

FIG. 6 is a side cross-sectional view of a portion of a second preferred embodiment of an end assembly of the inventive system. The end assembly comprises outer aluminum plate 50 and inner aluminum plate 51. Inner plate has slots 54 extending through it, each slot for receiving the end of a radiating lamp.

Figure 7:
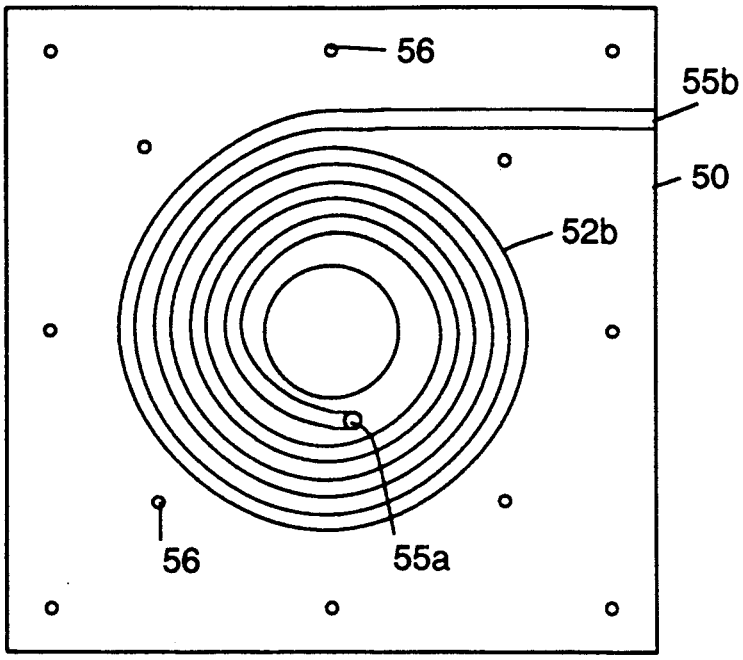
FIG. 7 is a cross-sectional view of the outer plate of the FIG. 6 assembly, taken along line 7—7 in FIG. 6.
Figure 8:
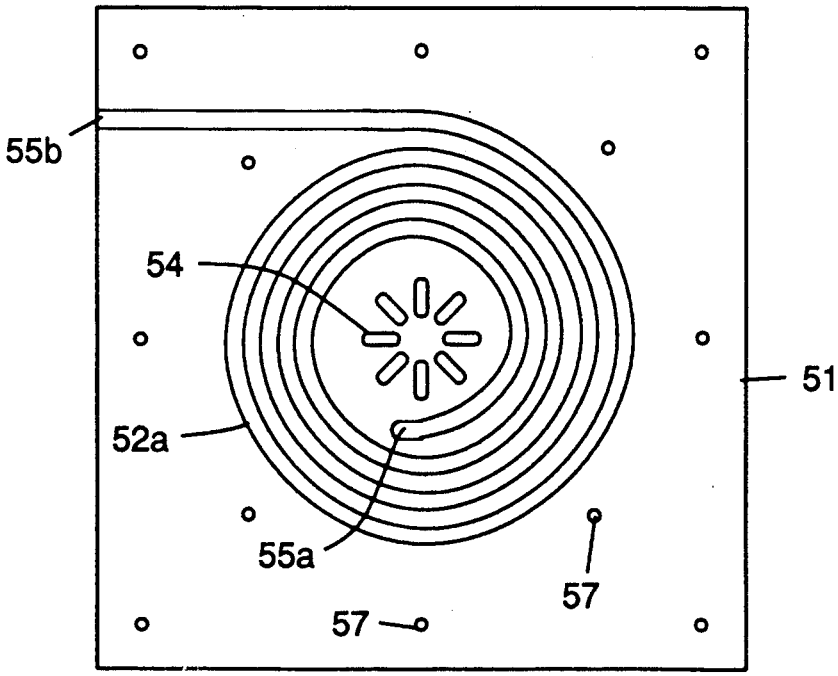
FIG. 8 is a cross-sectional view of the inner plate of the FIG. 6 assembly, taken along line 8—8 in FIG. 6.

FIG. 7 is a cross-sectional view of plate 50, taken along line 7—7 in FIG. 6, and FIG. 8 is a cross-sectional view of plate 51, taken along line 8—8 in FIG. 6. A spiral channel 52*b* is cut in one surface of plate 50, and matching spiral channel 52*a* is cut into the facing surface of plate 51.

A set of holes 56 extend through plate 50. Plate 51 has holes 57 that align with holes 56 when plates 50 and 51 are aligned as shown in FIG. 6. When so aligned, plates 50 and 51 may be fastened together by clamping screws or bolts 58 (shown in FIG. 6, but not in FIGS. 7 and 8) extending through holes 56 and 57.

When plates 50 and 51 are assembled together, channels 52*a* and 52*b* form a spiral duct. Before the plates are assembled together, a coil of chemically inert, thermally conductive tubing 53 (shown in FIG. 6, but not in FIGS. 7 and 8) in inserted in one of the channels 52*a* and 52*b*. Tubing 53 is preferably composed of Teflon. Thus, when the plates are assembled together, tubing 53 will line the spiral duct. When the plates are fastened together (such as by tightening screws 58), the duct walls compress tubing 53 radially inward. Thus, when the invention is assembled, there will be good thermal contact between plates 50 and 51 and process fluid flowing within tubing 53. It may be desirable to fill any gaps between tubing 53 and the duct walls with silicone rubber or the like, to enhance the thermal conductivity of the assembled unit.

Either or both of tubing 53, and the duct formed by aligned channels 52*a* and 52*b*, may be non-circular. If tubing 53 is composed of flexible material such as Teflon, it will conform to the duct wall shape when compressed by plates 50 and 51.

First end portion 55*a* of channel 52*b* extends completely through plate 50, so that process fluid may be pumped into one end of tubing 53 through portion 55*a*. The other end of tubing 53 is positioned at second end portion 55*b* of channels 52*a* and 52*b*. Unheated process fluid flowing through tubing 53 (from end 55*a* to end 55*b*) absorbs heat that has been transferred to plates 50 and 51 from the lamps.

Figure 10:
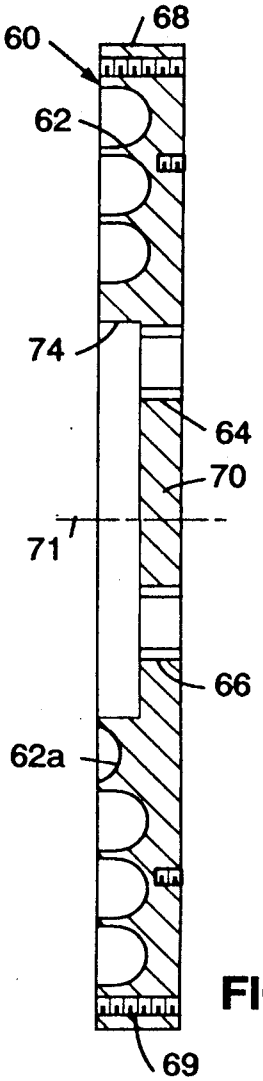
FIG. 10 is a cross-sectional view of the FIG. 9 assembly, taken along line A—A in FIG. 9.
Figure 9:
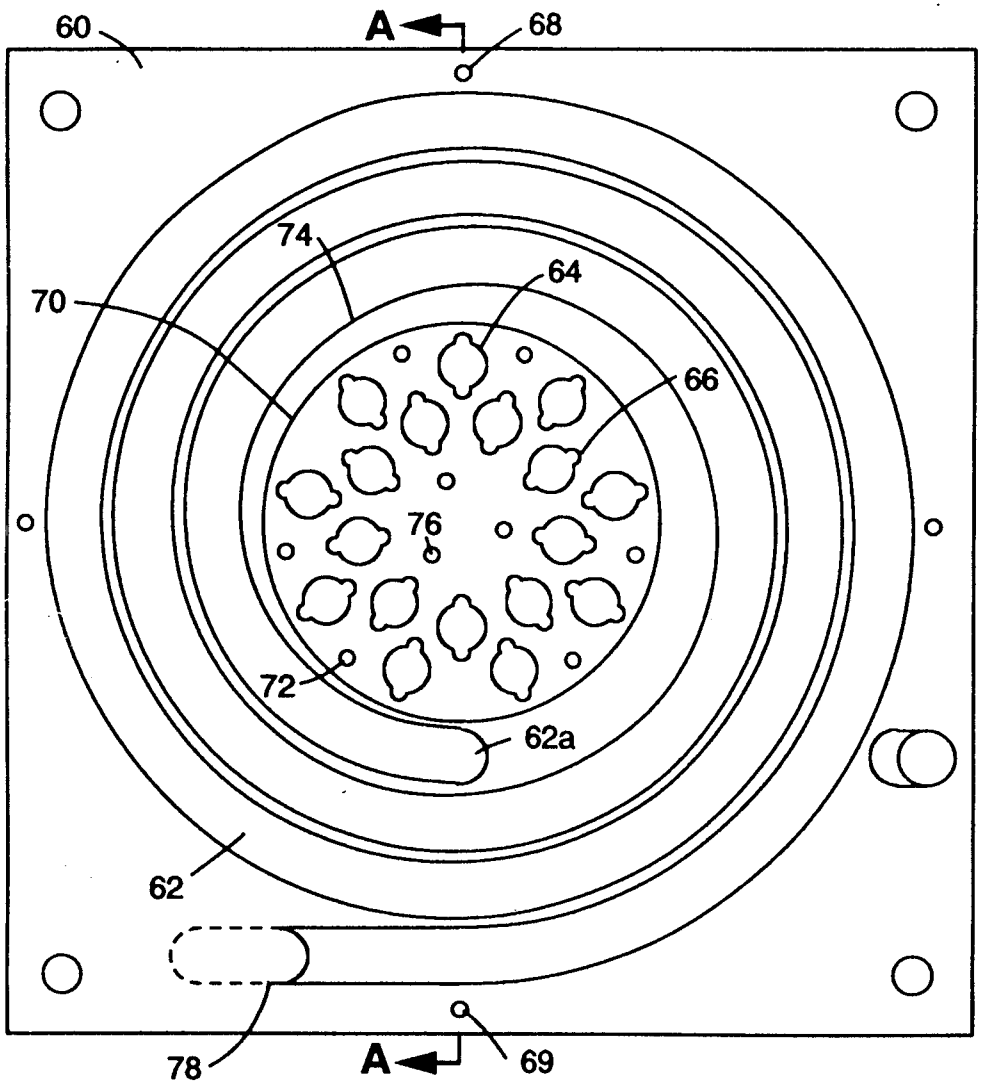
FIG. 9 is a cross-sectional view of an end portion of a third preferred embodiment of the inventive system.
Figure 1A:
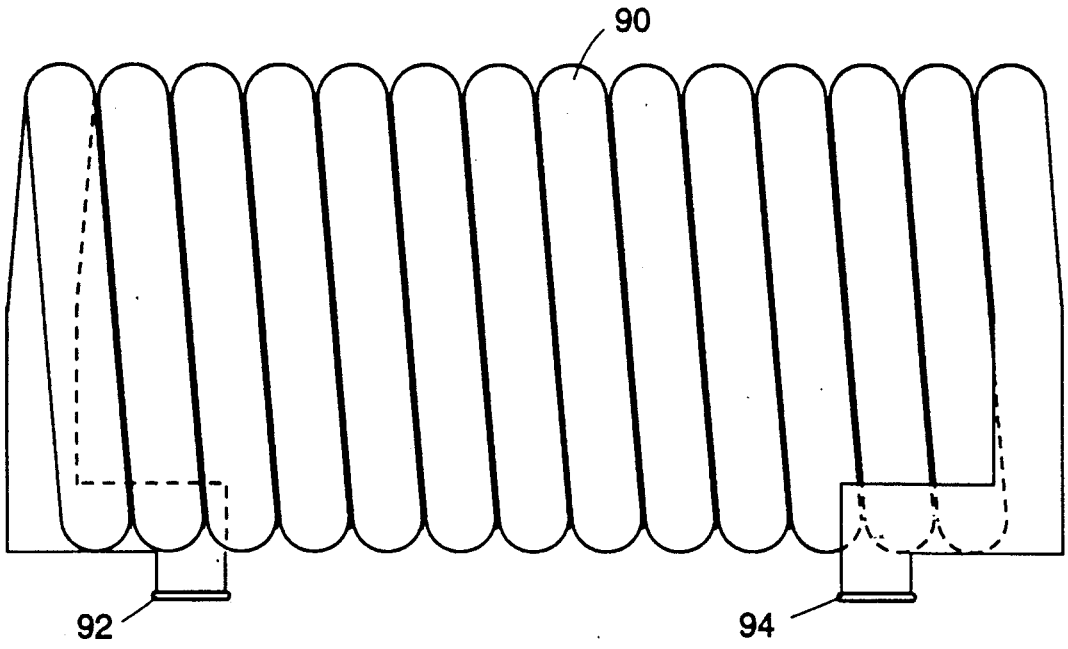

FIG. 9 is a cross-sectional view of an end portion of another preferred embodiment of the invention. FIG. 10 is a cross-sectional view of FIG. 9, taken along line A—A. The embodiment of FIGS. 9 and 10 is designed so that a first set of nine elongated lamps may be mounted in outer ring of slots 64 in portion 70, and a second set of nine elongated lamps may be mounted concentrically inside the first set in inner slots 66 of portion 70. It is contemplated that the longitudinal axis of each lamp will be substantially parallel to axis 71 (shown in FIG. 10). Portion 70 of plate 60 has holes 72 extending through it, so that portion 70 may be attached to other end assembly components by screws or the like. Plate 60, including portion plate 70 will be composed of thermally conductive material.

Plate 60 has holes 68 and 69 for attaching plate 60 to other system components by screws or the like extending through such holes. Spiral channel 62 is cut into one face of plate, 60, and is dimensioned for receiving TEFLON tubing (not shown). Unheated process fluid will enter the TEFLON tubing at end 62*a* of channel 62, and will then flow around channel 62 to outlet end 78 of the channel. The TEFLON tubing will be connected at outlet 78 to a quartz coil (such as that shown in FIGS. 11A and 11B) positioned for receiving radiation emitted by the lamps. Thus, the process fluid will cool each lamp mounted in one of slots 64 and 66 by conducting heat away from plates 60 and 70 (and the TEFLON tubing which lines channel 62 of plate 60).

Figure 11B:
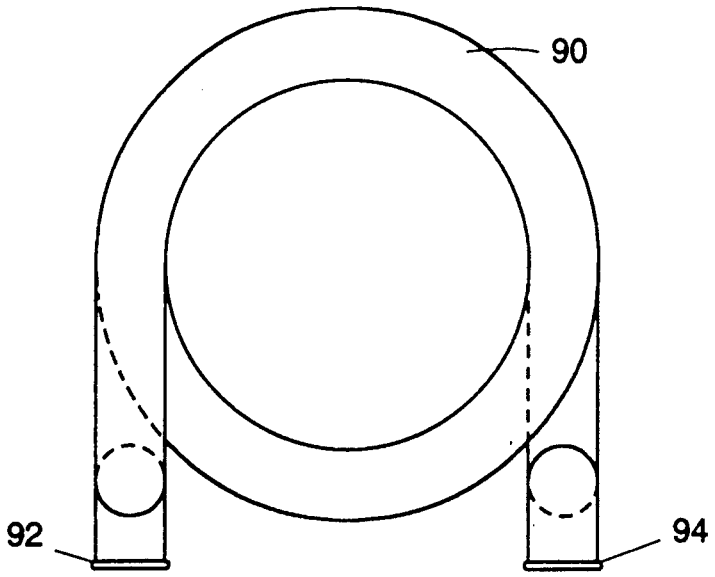
FIG. 11B is an end view of the coil shown in FIG. 11A.

Quartz coil 90, shown in FIGS. 11A and 11B, has an inlet end 92 and an outlet end 94. Process fluid may flow through coil 90 from end 92 to end 94. Coil 90 is suitable for positioning between any two of the end plate assemblies described herein. For example, coil 90 may be substituted for annular tube 12 in the FIG. 1 embodiment.

Figure 12:
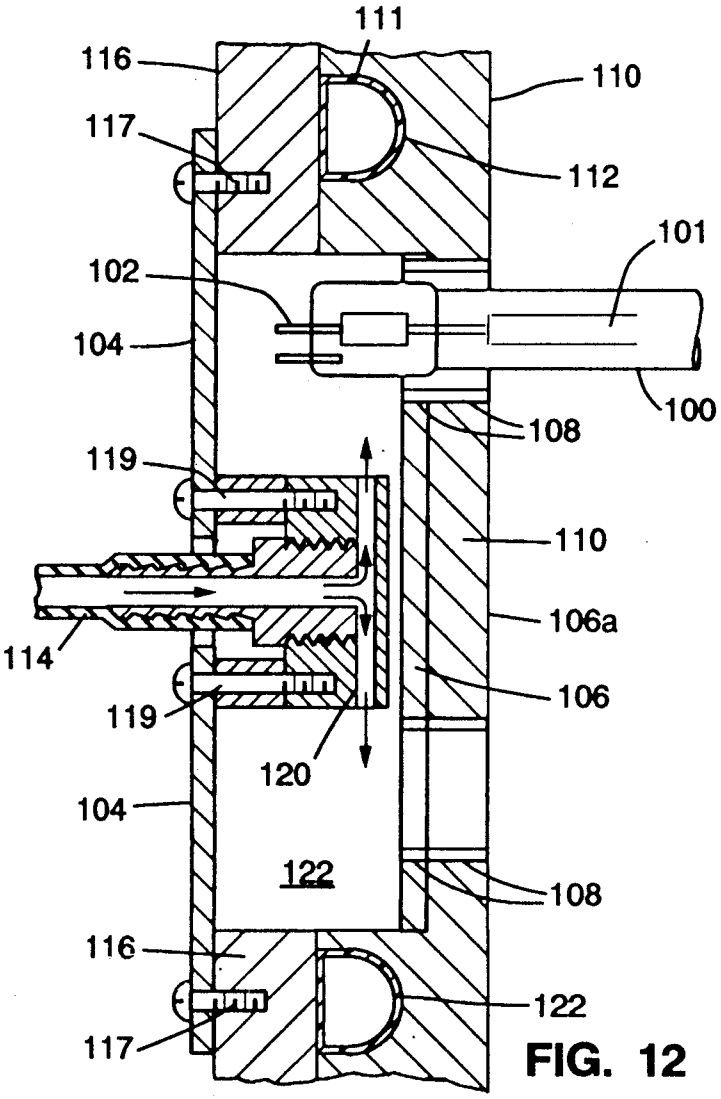
FIG. 12 is a side cross-sectional view of an end assembly of a fourth preferred embodiment of the inventive system.

FIG. 12 is an embodiment of the inventive end plate assembly, which is cooled by externally supplied gas as well as by unheated process fluid. The FIG. 12 assembly includes retaining ring 106 (having slots 108),, plate 110 attached to ring 106 (having slots 108, and a spiral duct 112 lined with chemically inert tubing 111 through which process fluid may flow), and outer plate 116 attached to plate 110. Each slot 108 is dimensioned for receiving a lamp such as lamp 100. Filament 101 extends within lamp 100, and electrical lead 102 emerges from an end of lamp 100.

Reflecting surface 106*a* of plate 106 reduces the heating of plate 106 by reflecting incident radiation from lamps 100. In order to cool the entire end plate assembly (including plates 106, 110, and 116), spiral channel 112 is cut in one surface of 110, and chemically inert tubing 111 (such as TEFLON tubing) is inserted in channel 112. Unheated process fluid flowing within tubing 111 absorbs heat (by conduction) from surrounding plates 110 and 116.

To further cool the FIG. 12 end plate assembly, pressurized gas flows into chamber 122 (in which the ends of lamps 100 extend) from nozzle assembly 114. Nozzle assembly 114 is mounted on support member 104, for example by screws 119. Member 104 is attached to plate 116, for example by screws 117. The pressurized coolant gas, after absorbing heat as it circulates within chamber 122, will escape from chamber 122 by flowing past member 104.

Figure 13:
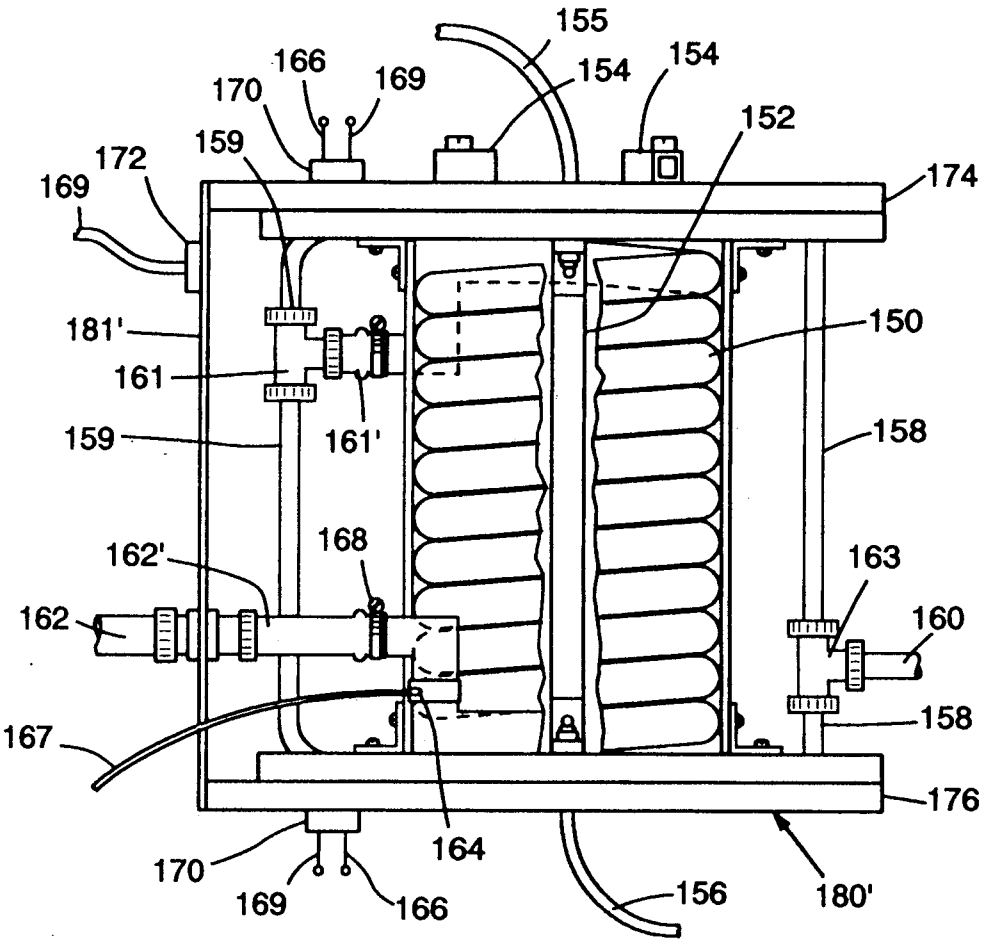
FIG. 13 is a partial top view of a heating assembly including the FIG. 12 assembly.
Figure 14:
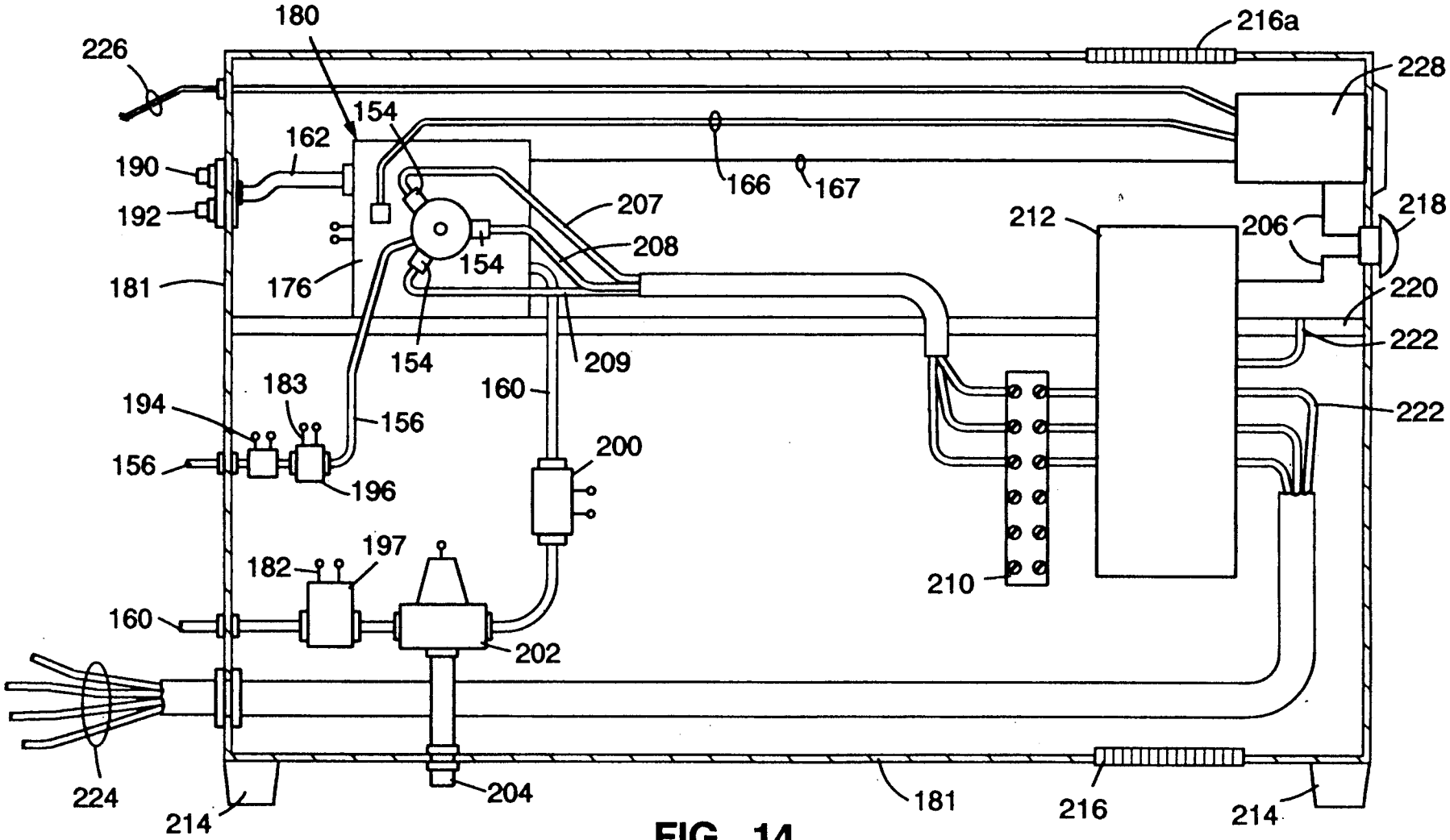
FIG. 14 is a side view of an embodiment of the inventive system which includes a variation on the heating assembly shown in FIG. 13.

FIG. 13 is a top view of an embodiment of the inventive heating assembly which includes the FIG. 12 assembly. FIG. 14 is a side view of a system including a variation on heating assembly 180' shown in FIG. 13. The FIG. 14 heating assembly (assembly 180) differs from assembly 180' in FIG. 13 only in that power terminals 154 are attached to end plate assembly 174 in FIG. 13, but are attached to the opposite end plate assembly (assembly 176) in FIG. 14.

In FIGS. 13 and 14, process fluid heater assembly 180 includes quartz coil 150 (wrapped with aluminum foil), quartz coil support member 152 attached above coil 150, and a set of radiating lamps (not shown). Assembly 180 is supported by end plate assemblies 174 and 176, cabinet 181, cabinet support member 220 within cabinet 181, and bulkhead 181'. Feet 214 allow air to flow under cabinet 181. Air inlet vent 216 and air exhaust vent 216*a* in cabinet 181 provide ventilation.

In operation, a thermally insulating blanket (not shown) will normally surround assembly 180. The blanket is preferably wrapped around assembly 180 after the quartz coil is mounted and all fluid lines have been connected together. Slots can be cut in the blanket for the fluid inlet and outlet lines. The fluid lines are preferably connected together before the insulating blanket is wrapped around the heating assembly to prevent contamination of the fluid lines with insulation particles.

Progress fluid from inlet line 160 is supplied through TEFLON lines 158 to end assembly tubing coils (such as tubing coil 111 shown in FIG. 12) within each of end plate assemblies 174 and 176. After flowing around such end assembly tubing coils, the process fluid enters TEFLON lines 159. Lines 159 are connected to the inlet ports of T-connector 161, and the output port of connector 161 is connected to flexible TEFLON line 161'. Line 161' supplies the combined process fluid flow to wrapped quartz coil 150. Heated process fluid emerges on flexible TEFLON outlet line 162' from wrapped quartz coil 150 within heater assembly 180. Line 162' is connected to the outlet end of the quartz coil by hose clamp 168. Line 162' is connected (by connection means at bulkhead 181') to outlet line 162. The function of flexible lines 161' and 162' is to reduce mechanical loading on the quartz coil.

Coolant gas is supplied from lines 155 and 156 to end plate assemblies 174 and 176, respectively. The incoming flow of gas within line 156 is controlled by solenoid valve 196 and manually-operable regulator 194. In the same way, the flow of gas within line 155 may be controlled by a solenoid valve and regulator (not shown).

Electric power (for example, 480 volt electric power) is supplied on cables 207, 208, and 209 (shown in FIG. 14) to terminals 154. Each terminal 154 is in turn connected to a subset of the set of radiating lamps surrounded by coil 150 within assembly 180. Cables 207, 208, and 209 are connected to power terminal 210, which is in turn connected to main power switch and heat sink assembly 212. Electric power (for example 480 volt, 3 phase, 110 amp power) is supplied to assembly 212 on cables 224. In response to an appropriate control signal on line 206 from circuit 228 (to be discussed in greater detail below with reference to FIG. 15), switch assembly 212 will vary the power to the radiating lamps. Assembly 212 and cabinet support member 220 are grounded 1 by lines 222.

Use of 480 volt power is desirable because it is more efficient than lower voltage power, and the associated wiring will be smaller and less expensive. Use of substantially lower voltage power will likely require use of additional heating elements to increase (by a desired amount) the temperature of a given flow rate of process fluid.

Each of cables 207, 208, and 209 will supply power to a different subset of the lamps. In variations on the embodiment shown, two or more heating assemblies, each identical to assembly 180, may be employed. An additional set of three cables (identical to cables 207, 208, and 209) would supply the power for all the lamps in each additional heating assembly. In embodiments including two or more heating assemblies, the inlet process fluid flow on line 160 would be divided into substantially equal portions, with each portion being routed to a different one of the heating assemblies.

The flow of process fluid within inlet line 160 is controlled by solenoid valve 197 and over-pressure valve 202. Valve 202 directs the process fluid flow to over-pressure drain 204 when pressure in line 160 exceeds a selected amount, but otherwise does not impede the flow of fluid through line 160. Preferably, the process fluid inlet line 160 will run through a bulkhead fitting to minimize the mechanical load on Teflon tubing 158. Alternatively, T-connector 163 (which connects line 160 with lines 158) will be supported by a bracket attached to a bulkhead or to either of the end plate assemblies, in order to reduce the mechanical load on tubing 158.

Thermocouple 164 includes fast response foil encased in a laminate. Preferably, thermocouple 164 is encased in an inert casing and immersed in the process fluid at the outlet end of the quartz coil. A thermal fuse 170 is attached to each end plate assembly, preferably in a position as close as practical to the quartz coil. Lines 166 and 169 connect each fuse 170 into an over-temperature circuit and to heater level switch 172, respectively. Line 167 connects thermocouple 164 to temperature control circuit 228. If the temperature of one of fuses 170 or thermocouple 164 rises to a selected level, temperature control circuit 228 will disconnect the lamps from their power supply, to prevent further radiation emission from the lamps. Another thermocouple device may be attached to or near the center of the quartz coil, if additional thermal override sensing capability is desired.

Cable 226 supplies 120 volt electric power to temperature control circuit 228.

Figure 15:
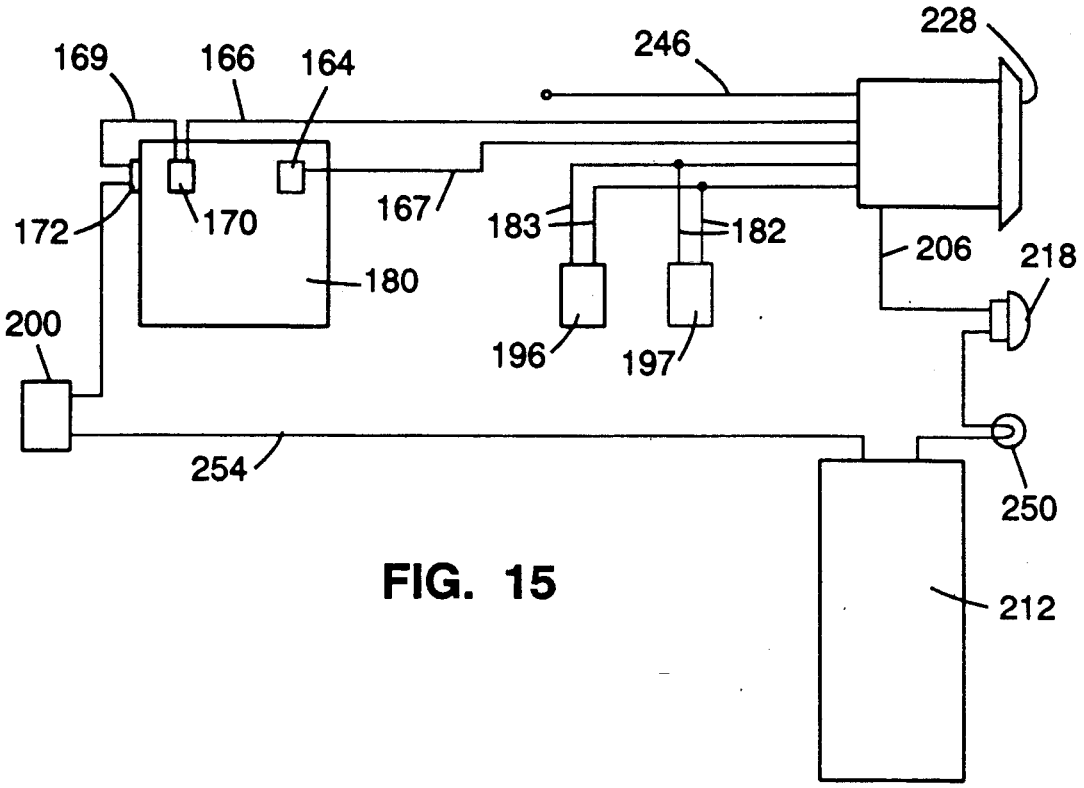
FIG. 15 is a block diagram of the electrical control circuitry of the FIG. 14 system.

FIG. 15 is a block diagram of the electrical control circuitry of the system shown in FIG. 14. Temperature controller circuit 228 is connected to main power switch 212 by line 206. One or both of manually operated switch 218 and alarm light (or audio alarm device) 250 may be connected in series along line 206. In response to a "start" signal supplied on line 246 to circuit 228, circuit 228 will generate a control signal on line 206 causing the main power switch 212 to supply a particular level of power to the radiating lamps (for example, through cables 207, 208, and 209 of FIG. 14). Circuit 228 controls the level of power supplied by main power switch 212 to the radiating lamps, by varying the control signal on line 206.

Flow switch 200, heater level switch 172, fuse 170, and lines 254, 166, 169, and 206 are all connected in series with circuit 228 and switch 212. Switch 200 will open (thereby disconnecting power from the lamps) in the event that the fluid flow rate through it falls below a selected value. Switch 172 will open (thereby disconnecting power from the lamps) in the event that the inventive system is tilted away from a horizontal orientation.

Feedback to circuit 228 from the thermocouple 164 (on line 167) will cause circuit 228 to vary continuously the power to the lamps, as required to maintain a desired temperature at thermocouple 164 (shown in phantom view in FIG. 15).

Circuit 228 will also generate control signals on lines 182 and 183, for process fluid inlet solenoid valve 197 and coolant gas solenoid valve 196, respectively. Such control signals will cause solenoid valves 197 and 196, respectively, to allow or prevent the flow of process fluid and coolant gas therethrough. Preferably, process fluid will flow into heating assembly 180 at a minimum flow rate (i.e., one gallon per minute) at all times when electric power is supplied to the lamps, in order to supply sufficient fluid coolant to the end plate assemblies to prevent meltdown of the heating assembly.

It is contemplated that the opening of switch 218 (for example, manually, by a system operator) will not only cause switch 212 to disconnect power to the lamps, but will also activate alarm 250.

Circuit 212 will preferably be designed so that any waste heat resulting from power dissipation therein will escape into the ambient air.

One of ordinary skill in the art of electric control circuit design will be able to design circuit 228 and switch 212 as a matter of routine engineering design choice. Alternatively, commercially available circuits may be employed. For example, a Model UT40 Process Controller circuit, available from Yokogawa Corporation in Atlanta, Ga., is suitable for use as temperature control circuit 228. Where three phase 480 volt power is employed, switch 212 will preferably be a three phase, solid state switching system.

Many embodiments of the invention have low thermal inertia and rapid heat transfer rate, so that circuit 228 should accordingly have a short response time.

In alternative embodiments, a flow meter will be inserted in process fluid inlet line 160. If the flow meter output signal is proportional (or otherwise related in a known manner) to the power required to raise incoming process fluid by a desired temperature difference, the flow meter output signal may be processed in computing means (which may comprise software or firmware) within circuit 228 to generate control signals for controlling the amount of power supplied to the lamps.

Figure 16:
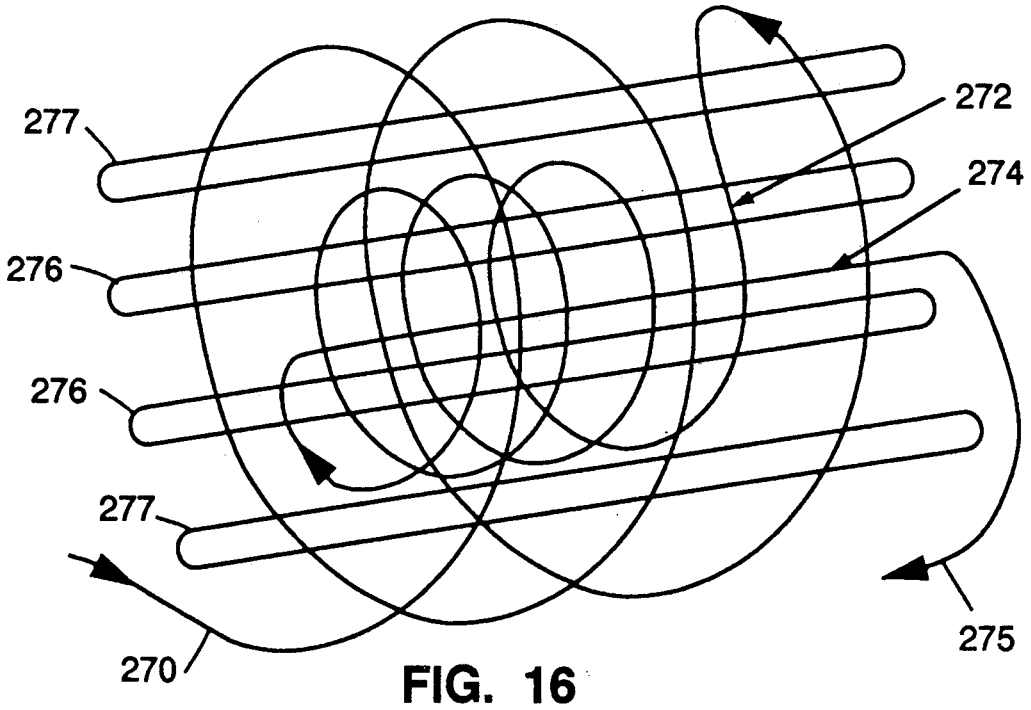
FIG. 16 is a simplified perspective view of an alternative embodiment of the quartz coil of the invention.

FIG. 16 is a simplified perspective view of an alternative embodiment of the quartz coil of the invention. In the FIG. 16 embodiment, the quartz coil has a large diameter outer coil portion 270, a small diameter inner coil portion 272, and a central linear tube portion 274. Inner elongated lamps 276 are positioned parallel to tube portion 274 (at a first radial distance from portion 274) between coil portions 272 and 274. Outer elongated lamps 277 are positioned parallel to tube portion 274 (at a second, larger, radial distance from portion 274) between coil portions 270 and 272. Process fluid enters coil portion 270, then flows through portion 272, and then through portion 274, and finally exits the quartz coil at outlet end 275 of portion 274.

Figure 17:
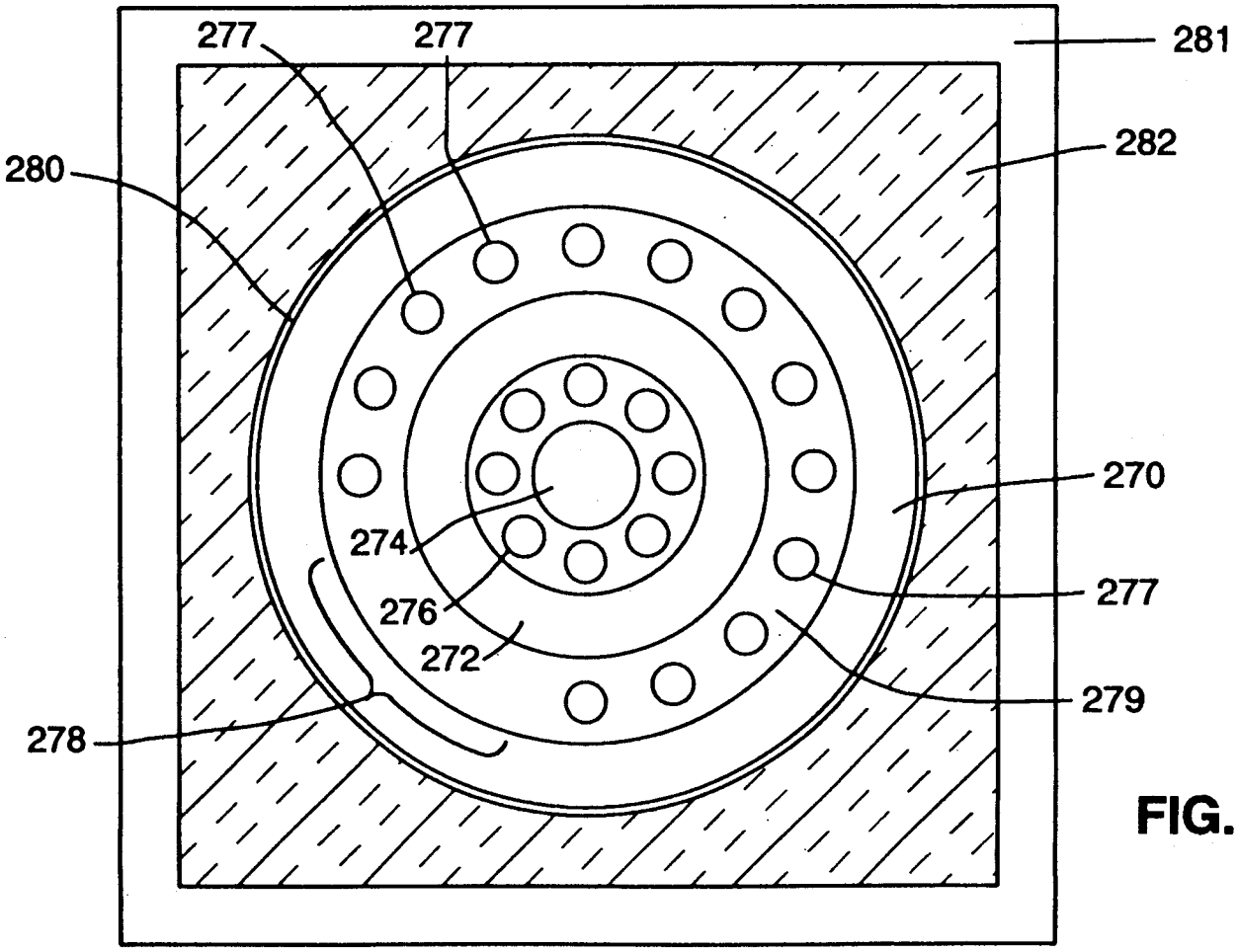
FIG. 17 is simplified cross-sectional view of an embodiment of the invention employing the coil shown in FIG. 16.

FIG. 17 is simplified cross-sectional view of an embodiment of the invention employing the coil shown in FIG. 16. FIG. 17, linear quartz tube portion 274 is surrounded by eight lamps 276. Lamps 276 are surrounded by inner coil portion 272, and coil portion 272 is surrounded by lamps 277. Lamps 276 and 277 are positioned in volume 279 (which will typically be filled with air). Sector 278 of volume 279 is not occupied by lamps. Coil portion 270 surrounds lamps 277. Reflecting foil 280 surrounds coil portion 270, and thermal insulation 282 surrounds foil 280. Housing 281 surrounds insulation 282.

Figures 18, 19:
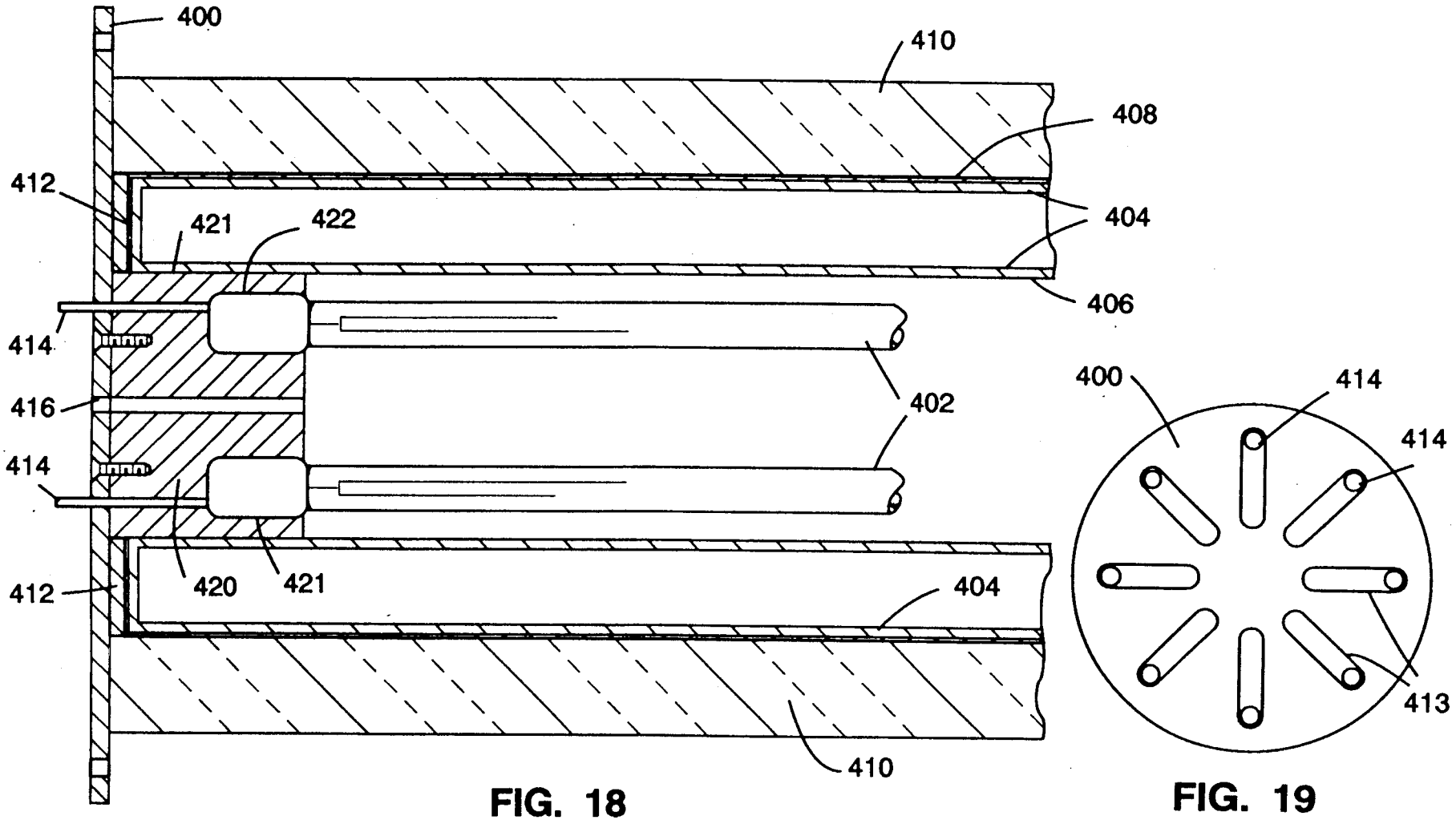
FIG. 18 is a side cross-sectional view of a portion of a fifth preferred embodiment of the inventive system.
FIG. 19 is an end view of a portion of the FIG. 18 assembly.

FIG. 18 is a side cross-sectional view of an end portion of a fifth preferred embodiment of the inventive system. In FIG. 18, the process fluid flows through annular quartz tube 404. Tube 404 has an inner cylindrical surface 406, which surrounds lamps 402. Reflecting foil 408 surrounds the outer cylindrical surface of tube 404, and thermal insulation 410 is wrapped around foil 408. The left end of tube 404 is attached by thermally insulating material 412 to end plate 400. Ventilation passage 416 extends through plate 400.

Ends 422 of lamps 402 are mounted in cylindrical plug 420. An electrical lead 414 extends from each lamp 402 through both plug 420 and plate 400. Plug 420 is machined from thermally conductive, reflective material such as aluminum, and is fixedly attached to plate 400 (for example, by screws). Outer cylindrical surface 421 of plug 420 is in contact with the inner surface 406 of quartz tube 404. Thus, heat may diffuse from lamp ends 422, through plug 420 and surface 406, to the process fluid flowing within tube 404.

FIG. 19 is an end view of plate 400. Eight slots 413 extend through plate 400, so that up to eight lamps may be mounted in plug 420, each with its lead 414 extending through one of slots 413 as shown.

Figure 20:
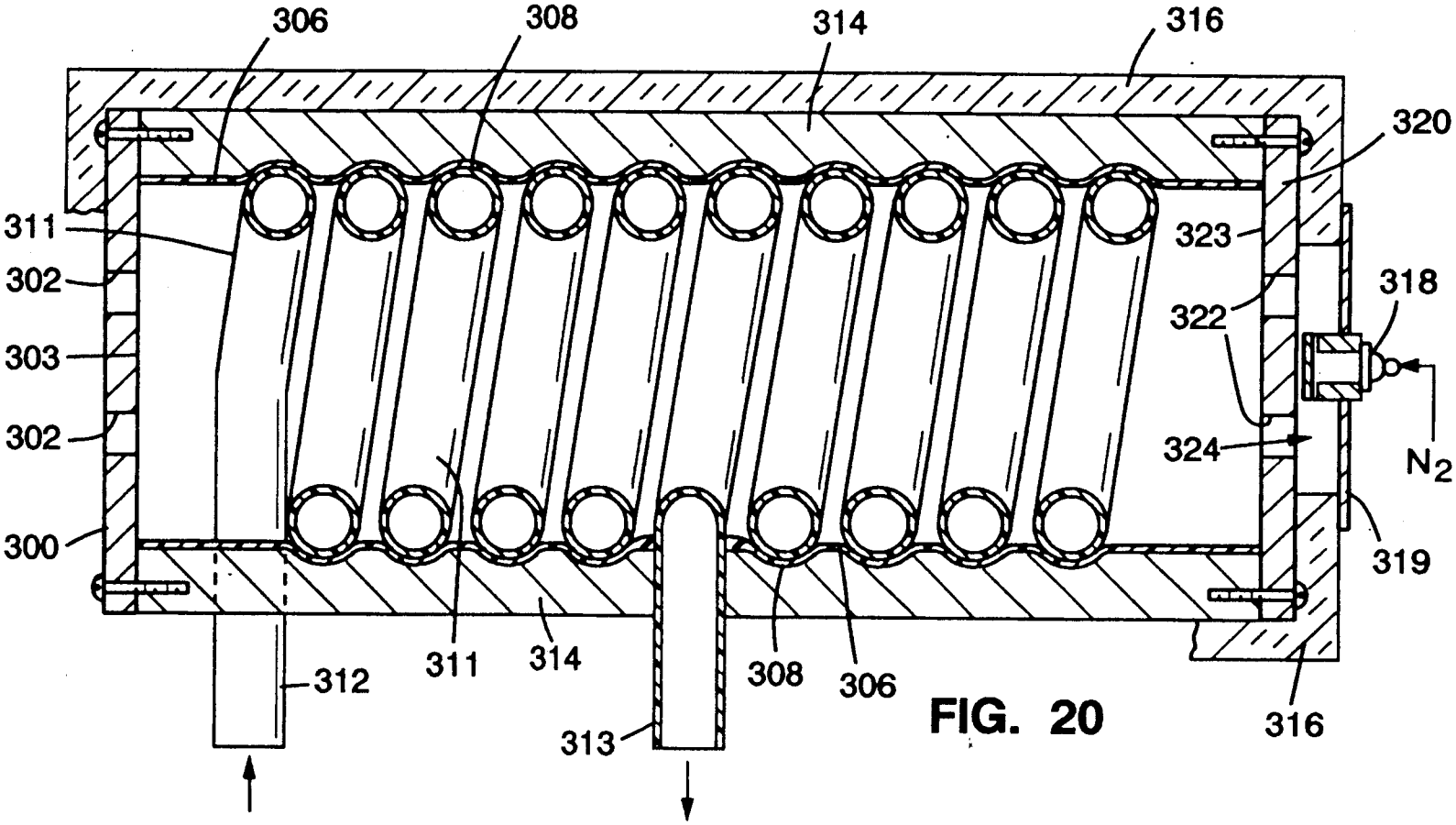
FIG. 20 is a side cross-sectional view of a portion of a sixth preferred embodiment of the inventive system.

FIG. 20 shows another preferred embodiment of the invention, having a gas-cooled end plate assembly (which includes end plate 320). The end plate assembly of FIG. 20 differs from the assembly described with reference to FIG. 12, in that the FIG. 20 assembly does not include a spiral channel for mounting process fluid tubing. In FIG. 20, end plates 300 and 320 are fixedly attached to opposite ends of cylindrical frame 314. Plates 300 and 320, and frame 314 are preferably aluminum or copper. Plates 300 and 320 support a set of elongated radiating lamps (not shown). A first end of each radiating lamp is mounted in one of slots 302 of plate 300, and the other end of such lamp is mounted in one of slots 322 of plate 320.

Process fluid flows through quartz coil 311 from left inlet 312 adjacent plate 300 (and a right inlet, not shown adjacent plate 320) to central outlet 313. As it flows through coil 311, the process fluid is heated by radiation absorbed from the lamps. Inner surface 303 of plate 300 and inner surface 323 of plate 320 are highly reflective of the lamp radiation. Reflecting foil 306 is wrapped around the radially outer surface of coil 311, to direct outward propagating lamp radiation back (radially inward) toward the axis of the coil. Optionally, a silicone rubber layer 308 is applied between foil 306 and frame 314 to eliminate gaps therebetween. Thermally insulating material 316 is wrapped around frame 314.

Heat generated in end plates 300 and 320 due to radiant flux from the lamps will dissipate by diffusing radially outward through the end plates to cylindrical shell 314. When the temperature of shell 314 rises above the temperature of rubber gap filler 308 and foil 306 (and the portion of tubing 311 adjacent foil 306), heat will diffuse from shell 314 to the process fluid within tubing 311. The inner surface of shell 314, and optionally also end plate surfaces 303 and 323, are preferably milled to mate with the profile of coil 311, to improve heat transfer to and from shell 314.

In order to cool end plate 320 (and hence each lamp attached thereto), nozzle 318 directs flowing gas from an external source (not shown) into chamber 324 adjacent plate 320. Nozzle 318 is mounted on plate 319, and plate 319 is attached to insulating material 316. The gas (preferably nitrogen or clean dry air) will help to cool plate 320 (and each lamp end attached thereto) by convective heat transfer.

The lamps employed in the inventive system will emit electromagnetic radiation of infrared or longer wavelength (and optionally, other radiation as well). Most of the emitted radiation will preferably lie within a wavelength range selected for efficient absorption by the process fluid, and for efficient transmission through the inert tubing (which may be quartz) which contains the process fluid.

For example, where the process fluid flows through a quartz coil of the well known variety which efficiently transmits radiation having wavelength in the range from about 0.5 microns to about 5 microns, most of the radiation emitted by the lamps will preferably be infrared radiation having wavelength within this range.

Various modifications and alterations in the structure and method of operation of this invention will be apparent to those skilled in the art without departing from the scope and spirit of this invention. Although the invention has been described in connection with specific preferred embodiments, it should be understood that the invention as claimed should not be unduly limited to such specific embodiments.

What is claimed is:

1. A system for heating a process fluid, including:
a housing;
a set of lamps mounted within the housing, for emitting radiation having a wavelength at least as long as infrared radiation; and
chemically inert tubing mounted within the housing in a position separated from the lamps, for containing the process fluid while the process fluid absorbs radiation from the lamps, wherein the tubing has a longitudinal axis, and wherein the lamps are elongated and mounted generally parallel to the longitudinal axis; and
reflective material wrapped around the tubing in such a position that radiation from the lamps that has propagated through the tubing in a direction away from the longitudinal axis will reflect from the reflective material back into the tubing toward the longitudinal axis.

2. A system for heating a process fluid, including:
a housing;
a set of lamps mounted within the housing, for emitting radiation having a wavelength at least as long as infrared radiation; and
chemically inert tubing mounted within the housing in a position separated from the lamps, for containing the process fluid while the process fluid absorbs radiation from the lamps, wherein the housing includes an end assembly having a spiral duct extending therethrough, each of the lamps has an end mounted in the end assembly, a chemically inert liner is positioned within the spiral duct, and the liner has a first end connected in fluid communication with the chemically inert tubing so that unheated process fluid flowing through the liner will absorb heat conducted from the lamp ends to the end assembly.

3. The system of claim 2, wherein the liner is a tube composed of polytetratfluoroethylene material.

4. A system for heating a process fluid, including:
a housing;
a set lamps mounted within the housing, for emitting radiation having a wavelength at least as long as infrared radiation; and
chemically inert tubing mounted within the housing in a position separated from the lamps, for containing the process fluid while the process fluid absorbs radiation from the lamps, wherein the housing includes an end assembly, each of the lamps has an end mounted in the end assembly, and the end assembly includes a gas nozzles through which pressurized coolant gas may flow into the housing in order to cool the lamps, and wherein the end assembly includes:
a plate through which the duct extends; and
a chemically inert liner positioned within the duct, the liner having a first end connected in fluid communication with the chemically inert tubing so that unheated process fluid flowing through the liner will absorb heat conducted from the lamps to the end assembly.

5. A fluid heating system, including:
a first end assembly, including a first end plate, wherein a duct extends through the first end plate;
a second end assembly, including a second end plate;
a set of lamps, each of the lamps having a first end attached to the first end plate and a second end attached to the second end plate, wherein each of the lamps emits radiation having infrared or longer wavelength;

chemically inert tubing having a first end attached to the first end plate and a second end attached to the second end plate, wherein said tubing is positioned adjacent to but separated from the lamps, and wherein the tubing is dimensioned to contain process fluid so that the process fluid may flow through the tubing while absorbing radiation from the lamps;

radiation reflecting material surrounding the tubing, for reflecting back into the tubing radiation that has propagated through the tubing from the lamps; and a thermally conductive, chemically inert liner positioned within the duct, the liner having a first end connected in fluid communication with the tubing so that unheated process fluid flowing through the liner will absorb heat from the first end plate before entering the tubing.

* * * * *